US008336628B2

(12) United States Patent
Myerley

(10) Patent No.: US 8,336,628 B2
(45) Date of Patent: Dec. 25, 2012

(54) PRESSURE EQUALIZING A BALL VALVE THROUGH AN UPPER SEAL BYPASS

(75) Inventor: Thomas S. Myerley, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 445 days.

(21) Appl. No.: 12/582,378

(22) Filed: Oct. 20, 2009

(65) Prior Publication Data

US 2011/0088906 A1 Apr. 21, 2011

(51) Int. Cl.
*E21B 34/00* (2006.01)

(52) U.S. Cl. ..... 166/332.7; 166/334.2; 166/332.3

(58) Field of Classification Search ..... 166/332.3, 166/334.2, 332.7
See application file for complete search history.

(56) References Cited

U.S. PATENT DOCUMENTS 3,273,649 A 9/1966 Tamplen
3,421,733 A 1/1969 Steward, Jr.
3,667,505 A 6/1972 Radig
3,741,249 A 6/1973 Leutwyler
3,778,029 A 12/1973 Baker
3,799,204 A 3/1974 Watkins et al.
3,826,462 A 7/1974 Taylor
3,827,494 A 8/1974 Crowe
3,830,297 A 8/1974 Cockrell
3,849,218 A 11/1974 Beckwith et al.
3,850,242 A 11/1974 Crowe
3,853,175 A 12/1974 Boyadjeff et al.
3,854,502 A 12/1974 Mott
3,856,085 A 12/1974 Holden et al.
3,868,995 A 3/1975 Crowe
3,971,438 A 7/1976 Crowe
3,987,854 A 10/1976 Callihan et al.
4,044,835 A 8/1977 Mott
RE29,471 E 11/1977 Giroux
4,100,969 A 7/1978 Randermann, Jr.
4,103,744 A 8/1978 Akkerman
4,130,166 A 12/1978 Akkerman et al.
4,140,153 A 2/1979 Deaton
4,144,937 A 3/1979 Jackson et al.
4,197,879 A 4/1980 Young
4,278,130 A * 7/1981 Evans et al. ..... 166/66
4,288,165 A 9/1981 Fewel
4,289,165 A * 9/1981 Fredd ..... 137/625.32
4,368,871 A 1/1983 Young
4,446,922 A 5/1984 Bowyer et al.
4,448,216 A 5/1984 Speegle et al.
(Continued)

OTHER PUBLICATIONS

Andrews, Thad, et al., "Bidirectional Subsurface Mechanically Actuated Barrier Valve and Shifting Tool(s) Provide Superior Control and Reliability for Multistage Completions", OTC 21866, May 2011, 1-6.

(Continued)

*Primary Examiner* — Jennifer H Gay
*Assistant Examiner* — Michael Wills, III
(74) *Attorney, Agent, or Firm* — Steve Rosenblatt

(57) ABSTRACT

A pressure equalizing system allows flow past an upper seal on a movable member downhole that in turn allows pressure to be delivered from uphole into what had previously been an isolated low pressure zone. The pressure differential across the member is equalized before attempting to move the member into another position. The member is a ball in a ball valve for subterranean use.

18 Claims, 3 Drawing Sheets

U.S. PATENT DOCUMENTS

| | | | | |
|---|---|---|---|---|
| 4,452,311 | A * | 6/1984 | Speegle et al. | 166/324 |
| 4,478,286 | A | 10/1984 | Fineberg | |
| 5,052,657 | A | 10/1991 | Winship | |
| 5,346,178 | A | 9/1994 | Baker | |
| 5,564,502 | A | 10/1996 | Crow et al. | |
| 5,865,246 | A | 2/1999 | Brown | |
| 5,890,698 | A * | 4/1999 | Domytrak | 251/1.1 |
| 5,893,389 | A | 4/1999 | Cunningham | |
| 6,065,535 | A | 5/2000 | Ross | |
| 6,223,824 | B1 | 5/2001 | Moyes | |
| 6,260,850 | B1 | 7/2001 | Beall et al. | |
| 6,283,217 | B1 * | 9/2001 | Deaton | 166/332.7 |
| 6,296,061 | B1 * | 10/2001 | Leismer | 166/386 |
| 6,644,408 | B2 * | 11/2003 | Ives | 166/332.7 |
| 6,695,286 | B1 | 2/2004 | Florio et al. | |
| 6,698,712 | B2 * | 3/2004 | Milberger et al. | 251/58 |
| 6,708,946 | B1 | 3/2004 | Edwards et al. | |
| 6,848,509 | B2 | 2/2005 | Myerley | |
| 6,866,100 | B2 | 3/2005 | Gudmestad et al. | |
| 7,128,151 | B2 | 10/2006 | Corbett | |
| 7,537,052 | B2 | 5/2009 | Robichaux et al. | |
| 7,614,452 | B2 | 11/2009 | Kenison et al. | |
| 2001/0045285 | A1 | 11/2001 | Russell | |
| 2003/0056951 | A1 | 3/2003 | Kaszuba | |
| 2004/0035586 | A1 | 2/2004 | Gudmestad et al. | |
| 2004/0069489 | A1 | 4/2004 | Corbett | |
| 2004/0220448 | A1 | 11/2004 | Henkel et al. | |
| 2004/0226721 | A1 | 11/2004 | Feluch et al. | |
| 2006/0076062 | A1 | 4/2006 | Andersson | |
| 2006/0243329 | A1 | 11/2006 | Doble | |
| 2007/0113900 | A1 | 5/2007 | Greene et al. | |
| 2007/0119789 | A1 | 5/2007 | Layton | |
| 2008/0110632 | A1 | 5/2008 | Beall | |
| 2008/0217248 | A1 | 9/2008 | Gebauer | |
| 2009/0020291 | A1 * | 1/2009 | Wagner et al. | 166/332.7 |
| 2009/0050549 | A1 | 2/2009 | Kerfoot | |
| 2009/0184278 | A1 | 7/2009 | Beall et al. | |

OTHER PUBLICATIONS

Nowlin, Jr., W.D., et al., "Overview of Classes of Currents in the deep water region of the Gult of Mexico", OTC 12991, May 2001, 1-7.
Instanes, Geir, et al, "Acoustic Leak Monitoring on Subsea Valves", SPE 114256, Oct. 2008, 1-5.

* cited by examiner

PRESSURE EQUALIZING A BALL VALVE THROUGH AN UPPER SEAL BYPASS

FIELD OF THE INVENTION

The field of this invention is an equalizing pressure feature for subterranean or downhole valves and more particularly a way to equalize trapped lower pressure in a ball or plug of a valve without having to run a tool in the valve.

BACKGROUND OF THE INVENTION

Downhole valves are used to isolate portions of the wellbore for a variety of reasons such as for safety systems or to allow building a long bottom hole assembly in the wellbore, to name a few examples. Such valves have featured a rotating ball with a bore through it that can be aligned or misaligned with the path through the tubing string where the valve is mounted. The ball is surrounded by a sliding cage that is operated by a hydraulic control system from the surface. One such design that features opposed pistons actuated by discrete control lines is illustrated in US Publication 2009/0184278. This design was concerned about a pressure imbalance on an operating piston and provided a passage through the piston with two check valves 64, 70 in series to allow pressure equalization across the actuating piston with the ball in the closed position.

What can happen in this type of a ball valve that has upper and lower seats against the ball in the closed position is that pressure from downhole can rise, which leads to a pressure differential between the passage inside the ball and the downhole pressure. This pressure differential can distort the ball and make it hard or impossible for the piston actuation system to operate the ball back into the open position. One way this was solved is described in a commonly assigned application Ser. No. 12/366,752 filed on Feb. 6, 2009 and having the title Pressure Equalization Device for Downhole Tools. The solution described in this application was to use a tool that goes into the upper sleeve that hold a seat against the ball and separate the seat from the ball while providing pressure from the surface at the same time to equalize the pressure on the ball before trying to rotate it to the open position. The problem with this technique was that it required a run into the well with coiled tubing, latching and shifting the upper sleeve and associated seat enough to give access into the ball for equalizing pressure. One of the downsides of this technique was that the pressure admitted to try to equalize the pressure in the ball could be high enough to unseat the lower seat from the ball so that the higher pressure below the ball would get to above the ball. This technique also took time which cost the operator money and required specialized equipment at the well location, which could be remote or offshore and add yet additional costs to the effort to operate the ball when subjected to high differential pressures that increases opening friction or could distort the ball enough to make it hard for the hydraulic system to rotate it.

In flapper type safety valves such as U.S. Pat. No. 5,564,502 the preferred method to get pressure equalization on a closed flapper was to simply apply tubing pressure on top of it to reduce the differential before using the control system to try to rotate the flapper. Of course, the flapper is built to rotate open with pressure applied above so that this technique did not equalize pressure around the flapper when it was closed but simply built up pressure above it when it was closed. Other equalizer valves mounted in the flapper were actuated by the hydraulic system moving down a flow tube that impacted the equalizing valve before the flapper was engaged by the flow tube as seen in U.S. Pat. Nos. 6,848,509 or 4,478,286.

Also relevant are US Publications 2001/0045285; 2009/0184278 and U.S. Pat. Nos. 4,130,166; 4,197,879; 4,288,165; 4,446,922; 5,865,246; 6,223,824; 6,708,946; 6,695,286 and 4,368,871.

The basic components of the valve of FIG. 1 are reviewed in more detail in US Publication 2008/0110632 whose description is fully incorporated by reference herein as though full set forth. The portions of such valve relevant to the understanding of the present invention will be reviewed below in sufficient detail and for completeness so as to fully understand the operation of the claimed invention. While the actuation system of the valve in FIG. 1 in the present case is somewhat different in that it uses mechanically operated rod pistons to move the ball cage, the remainder of the structure of the ball and the way it seals and turns are the same with the further exception that the present invention is employed to equalize pressure as between the inside of the closed ball and the pressure below the ball by virtue of application of uphole pressure to accomplish a bypass of an uphole seal to achieve pressure equalization.

Those skilled in the art will better understand how pressure equalization is obtained before the ball is turned from a review of the detailed description of the preferred embodiment and the associated drawings while recognizing that the technique is by no means limited to downhole ball valves but can be used in a variety of tools where trapped pressure results in differentials that may damage the component to be moved or the actuating system for it if such differentials are not resolved before attempting to move the component. Those skilled in the art will further understand that the full scope of the invention is to be found in the appended claims.

SUMMARY OF THE INVENTION

A pressure equalizing system allows flow past an upper seal on a movable member downhole that in turn allows pressure to be delivered from uphole into what had previously been an isolated low pressure zone. The pressure differential across the member is equalized before attempting to move the member into another position. In the preferred embodiment the member is a ball in a ball valve for subterranean use.

DETAILED DESCRIPTION OF THE PREFERRED EMBODIMENT

Figure 1:
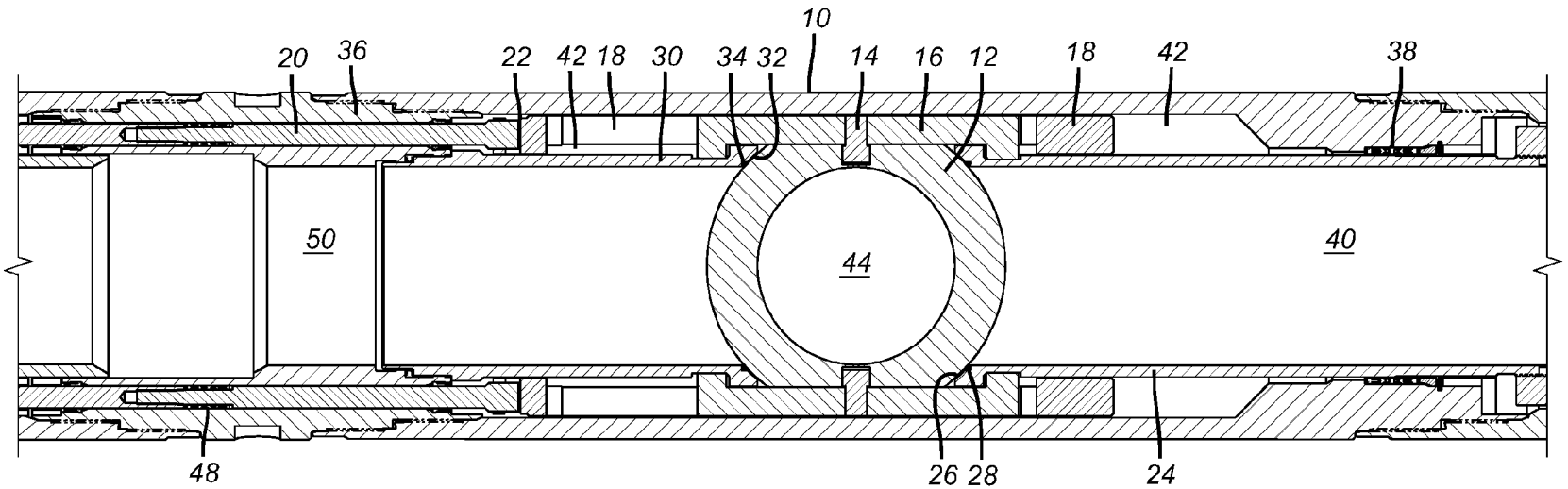
FIG. 1 is a section view of a ball valve in the closed position and including the portion where the pressure equalizing feature is located.

FIG. 1 shows a multi-component housing 10 that holds a ball 12 pinned at pins 14 to a frame 16. A cage 18 extends through the open frame 16 and is connected to the ball 12 offset from the center pivot pins 14 so that sliding the cage 18 in opposed directions results in 90 degree rotation of ball 12 between an open position and the illustrated closed position. A connecting rod assembly 20 is secured to cage 18 at connection location 22. A shifting tool (not shown) can engage the connecting rod assembly 20 to selectively move it back and forth to open or close the ball 12.

A lower seat sleeve 24 has a seat 26 in which a seal 28 is located for contact with the ball 12. The sleeve 24 is biased against the ball 12 by a spring that is not shown that is located on the housing 10 but further downhole. An upper seat sleeve 30 has a seat 32 in which a seal 34 is located for contact with the ball 12. The biasing spring that is not shown pushes the assembly of the lower seat sleeve 24, the ball 12 and its frame 16 and the upper seat sleeve 30 against housing component 36. The cage 18 moves relatively to the frame 16 and over the frame 16 to operate the ball 12. Seal 38 seals between the lower seat sleeve 24 and the housing 10. Together seals 38 and 28 retain downhole pressure in higher pressure zone 40 from reaching the intermediate zone which is also referred to as the lower pressure zone 42, which extends from below to above cage 18 and further encompasses the passage 44 inside the ball 12. In the closed position pressure in zone 42 migrates into passage 44 around the pins 14. Above the ball 12 the zone 42 is further defined by seal 34 located in the upper seat sleeve 30 as well as seal 46 shown in FIG. 2 and seal 48 around the pushrod assembly 20. Accordingly, an uphole pressure zone 50 is defined by these seals. The present invention deals with a pressure imbalance where pressure in zone 40 goes up when the ball 12 is in the closed position and a lower pressure is trapped in zone 42 which includes the passage 44 inside the ball 12. This pressure imbalance can increase opening friction or distort the ball 12 making it hard to rotate such that any attempt to rotate the ball 12 while under such a pressure imbalance can adversely affect the pushrod assembly 20 or its seal 48 or the ball 12 itself. The present invention allows pressure applied to zone 50 before rotating the ball 12 to get past seal 46 and into zone 42 which also includes the passage 44 in ball 12. Different embodiments are presented in FIGS. 2 and 3 that are discussed below.

Figure 2:
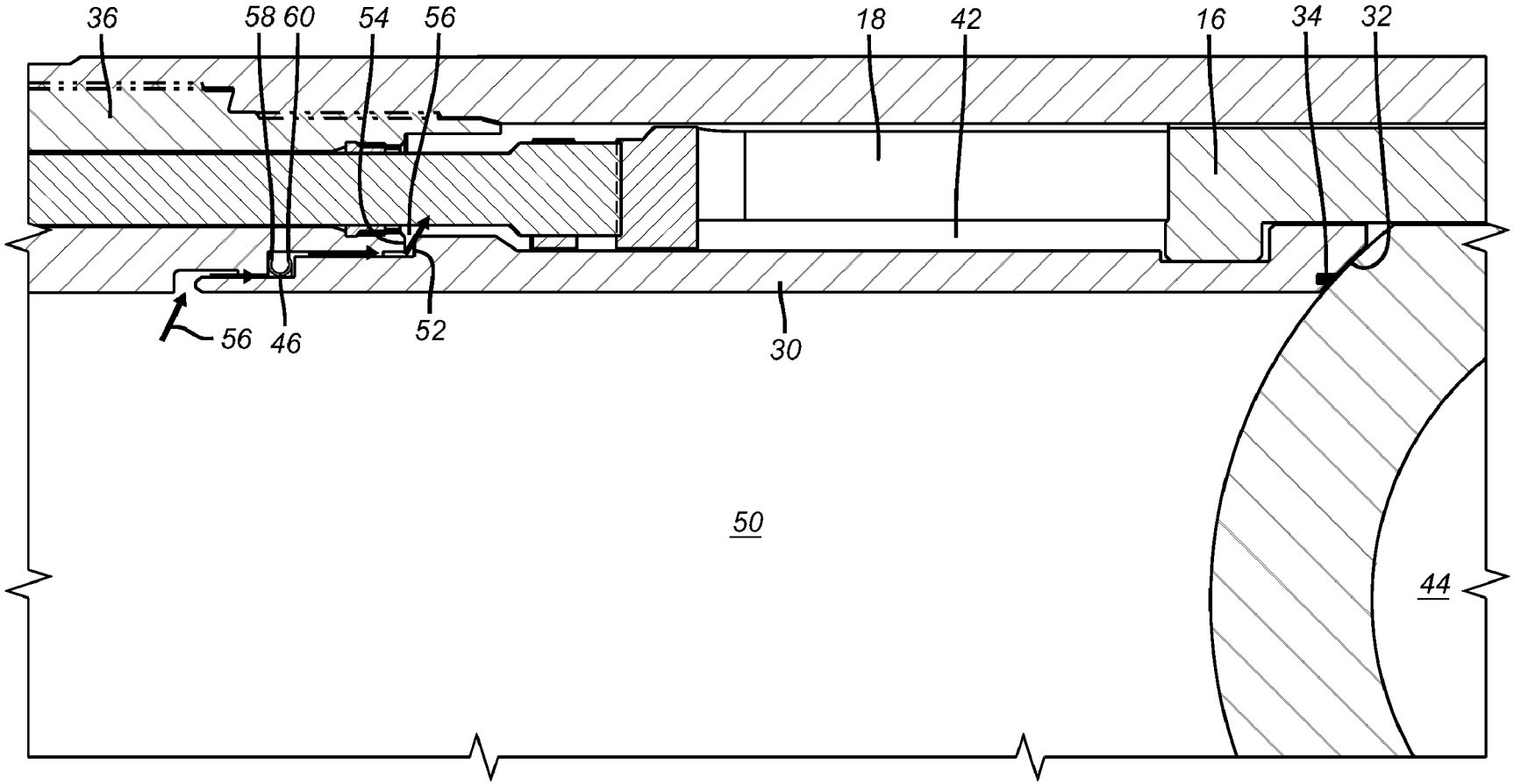
FIG. 2 is a close up view of the valve of FIG. 1 showing the path for pressure equalizing with applied pressure from above.

As seen in FIG. 2 the upper seat sleeve 30 has an external shoulder 52 that is biased by the spring previously described and not shown against shoulder 54 of housing component 36. While shown apart in FIG. 2 for clarity of illustration of the flow path into zone 42 represented by arrows labeled 56 surfaces 52 and 54 will normally be touching but there is no seal between them. To equalize pressure in zone 42 and include the flow passage 44 in the ball 12, the pressure is built up in zone 50 generally from the surface with available equipment or pressure sources. Normally, the pressure in zone 42 acts on preferably metallic seal 46 between legs 58 and 60 to spread them apart to retain pressure in zone 42 thus preventing pressure communication from zone 42 into upper zone 50. Keeping in mind that the objective is to cure the pressure imbalance between zones 42 and 40 by raising the pressure in zone 50 to a point of bypassing the seal 46 those skilled in the art will appreciate that the c-shaped ring seal 46 is configured to resist flow or pressure loss from zone 42 into zone 50 but is also able to permit flow and pressure migration when the pressure in zone 50 is raised substantially over the pressure in zone 42. During normal operations some leakage from zone 50 into zone 42 is acceptable because the volume will be insignificant to affect the operation of the valve assembly. The seal 46 has a u-shaped cross-section and is a commercially available seal.

Figure 3:
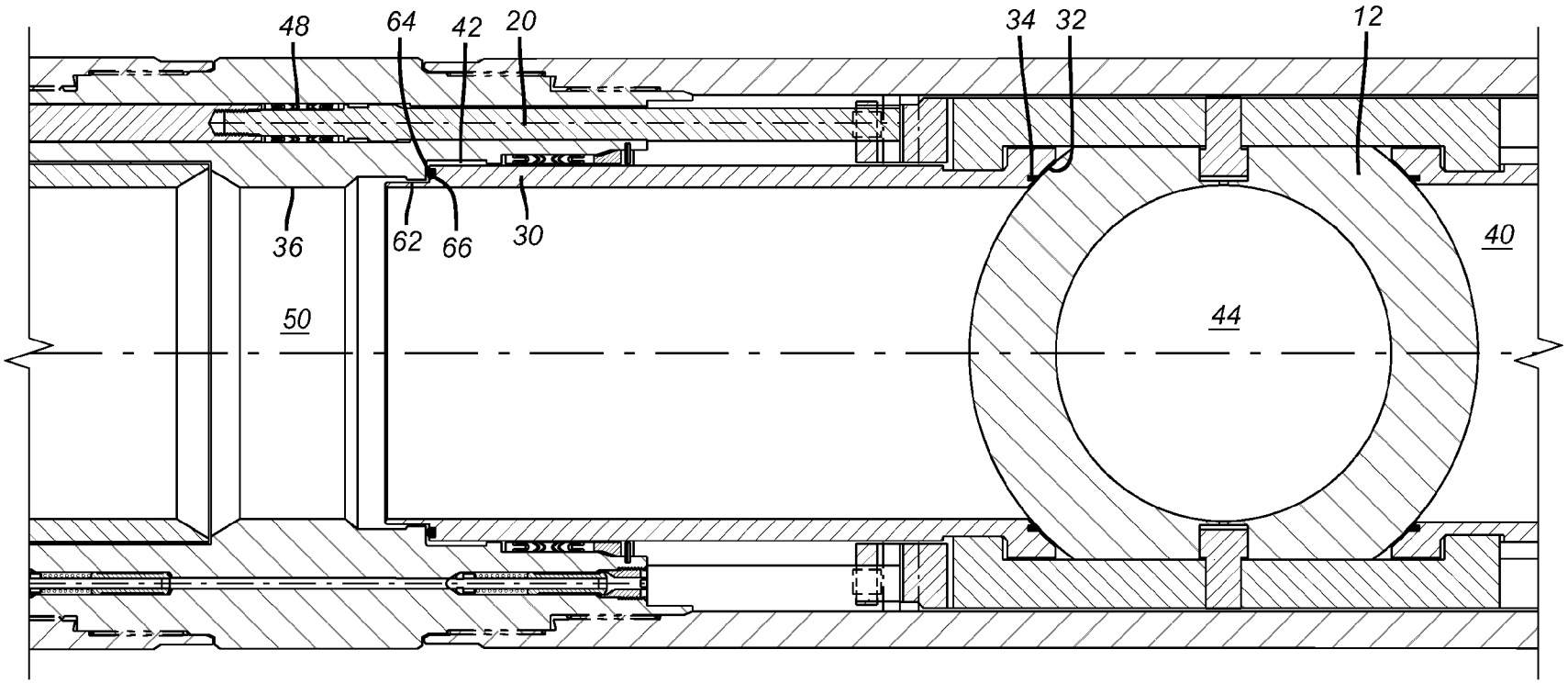
FIG. 3 is an alternative embodiment to the design of FIG. 2.

FIG. 3 is an alternative embodiment showing parts 30 and 36 having a small clearance 62 that is closed off by a seal 64 in a surrounding groove 66. The equalization concept in FIG. 3 is the same as in FIG. 2. Pressure is introduced from zone 50 which typically will come from the surface. At a predetermined differential between zones 50 and 42 the seal 64 will be pushed further back into groove 66 and flow will bypass the seal 64 increasing the pressure in zone 42 to get it closer to the pressure in zone 40 so that the connecting rod assembly 20 can be safely operated with little to no risk of damage to the assembly 20 or its seal 48 or the ball 12 itself.

Those skilled in the art can appreciate that the disclosed modes of pressure equalization are cheaper and faster than running a tool into the valve assembly to provide access into zone 42 by physically shifting a part such as seat sleeve 30 to get seal 34 away from ball 12 so that pressure from the wellhead can then be applied to equalize zone 42 with zone 40. In the present invention the housing does not need to be expensively machined for internal bypass passages that need one or more check valves which have small moving parts that also need protection from debris that may be in the well fluid. Instead, the mere creation of enough differential across a seal so that flow and pressure can migrate from zone 50 into zone 42 gets the job done and the ball 12 can then be operated in the normal manner.

The above description is illustrative of the preferred embodiment and various alternatives and is not intended to embody the broadest scope of the invention, which is determined from the claims appended below, and properly given their full scope literally and equivalently.

I claim:

1. A pressure equalizing system for a subterranean tool operable from a surface through a tubing string, comprising:

a housing having a passage therethrough and a movable member operable in said passage to selectively close said passage while defining a downhole pressure zone and an uphole pressure zone with respect to the moveable member, said zones separated by an intermediate pressure zone at the moveable member such that said movable member is subjected to a positive pressure differential of said downhole pressure zone with respect to said intermediate zone;

said uphole pressure and intermediate zones separated by at least one seal that is functional for pressure isolation of differential pressure between said uphole pressure and intermediate zones when said movable member selectively closes said passage, whereupon pressure buildup in said uphole pressure zone above a predetermined value said seal is bypassed as pressure is changed in said intermediate zone as flow from said uphole pressure zone into said intermediate zone brings said intermediate zone closer to the pressure in said downhole pressure zone to facilitate movement of said movable member to open said passage.

2. The system of claim 1, wherein:

said seal is a resilient ring seal.

3. The system of claim 2, wherein:

said seal has a circular cross section.

4. The system of claim 2, wherein: said seal is disposed in a groove and extends against an opposed sealing surface until pressure buildup in said uphole pressure zone moves said seal from said opposed sealing surface to allow pressure to build in said intermediate zone.

5. The system of claim 4, wherein:

said movable member comprises a ball having a flow path therethrough and an upper seat sleeve and a lower seat sleeve in sealing contact with said ball in said passage on opposed sides of said ball;

said seal is disposed on an outer surface of said upper seat sleeve to selectively seal against said opposing sealing surface located on said housing.

6. The system of claim 5, wherein:

said upper seat sleeve defining a clearance with respect to said housing in a path leading from said upper pressure zone to said seal with said intermediate pressure zone accessible on the opposite side of said seal from said clearance.

7. The system of claim 1, wherein:

said seal comprises a gapped cross-section defined by spaced legs.

8. The system of claim 7, wherein:

said gap is oriented toward said intermediate pressure zone.

9. The system of claim 8, wherein:

said movable member comprises a ball having a flow path therethrough and an upper seat sleeve and a lower seat sleeve in sealing contact with said ball in said passage on opposed sides of said ball;

said seal is disposed on an outer surface of said upper seat sleeve to selectively seal against said opposing sealing surface located on said housing.

10. The system of claim 9, wherein:

said ball is operated by a rod having a rod seal around it to seal to said housing to separate said high and intermediate pressure zones.

11. The system of claim 10, wherein:

said ball is operated to rotate in opposed directions to open and close said passage by a force applied to said rod.

12. The system of claim 9, wherein:

said lower seat sleeve further comprises a lower sleeve seal against said housing to isolate said lower pressure zone from said intermediate pressure zone.

13. The system of claim 9, wherein:

said lower seat sleeve comprises a lower seat with a resilient seal in said lower seat contacting said ball;

said upper seat sleeve comprises an upper seat with a resilient seal in said upper seat contacting said ball.

14. The system of claim 13, wherein:

a frame pivotally supports said ball on an axis through its center, said frame retaining said seals on said upper and lower seats to said ball.

15. The system of claim 14, wherein:

a cage is mounted through said frame and is connected to said ball off center from where said ball is pivotally supported by said frame such that axial movement of said cage rotates said ball.

16. The system of claim 15, wherein:

said ball is operated by a rod connected to said cage;

said rod having a rod seal around it to seal to said housing to separate said high and intermediate pressure zones.

17. The system of claim 16, wherein:

said ball is operated to rotate in opposed directions to open and close said passage by a force applied to said rod and transferred to said cage.

18. The system of claim 7, wherein:

said seal is metallic.

* * * * *